US006814066B2

(12) United States Patent
Ando

(10) Patent No.: US 6,814,066 B2
(45) Date of Patent: Nov. 9, 2004

(54) INTERNAL COMBUSTION ENGINE IGNITION DEVICE AND IGNITER FOR SAME

(75) Inventor: Koji Ando, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/817,848

(22) Filed: Apr. 6, 2004

(65) Prior Publication Data

US 2004/0200463 A1 Oct. 14, 2004

(30) Foreign Application Priority Data

Apr. 11, 2003 (JP) ..... 2003-108271

(51) Int. Cl.[7] ..... F02P 11/00
(52) U.S. Cl. ..... 123/644; 123/630; 123/651
(58) Field of Search ..... 123/644, 630, 123/651, 143 R, 146.5 R, 149 FA, 598

(56) References Cited

U.S. PATENT DOCUMENTS 5,970,964 A * 10/1999 Furuhata et al. ..... 123/644
6,186,129 B1 * 2/2001 Butler, Jr. ..... 123/620
6,194,884 B1 * 2/2001 Kesler et al. ..... 323/285
6,283,104 B1 * 9/2001 Ito et al. ..... 123/644
6,336,448 B1 * 1/2002 Furuhata et al. ..... 123/644
6,378,514 B1 * 4/2002 Kaminaga et al. ..... 123/633

FOREIGN PATENT DOCUMENTS

JP 8-28415 1/1996
JP 2001-248529 9/2001
JP 2002-4991 1/2002

* cited by examiner

*Primary Examiner*—John T. Kwon
(74) *Attorney, Agent, or Firm*—Nixon & Vanderhye P.C.

(57) ABSTRACT

An internal combustion engine ignition device able to suppress misfires etc. at abnormal times and achieving smaller size and lower cost, provided with an IGBT (switching device SW), a current limiting circuit for limiting a primary current running through the IGBT to within a predetermined value, a fast gate voltage drop circuit for making the gate voltage of the IGBT fast drop to an extent where spark discharge occurs at the spark plug, an abnormality detecting circuit for detecting an abnormal state of an igniter or electronic control unit and outputting an abnormality detection signal, and a slow gate voltage drop circuit having a gate voltage feed cutoff circuit for cutting off the feed of the gate voltage at an abnormal time and a discharge circuit for discharging the gate capacitor charge of the IGBT to make the gate voltage slowly drop to an extent where no spark discharge will occur at the spark plug.

6 Claims, 5 Drawing Sheets

IGNITION SIGNAL
MALFUNCTION DETECTING SIGNAL
IGBT GATE VOLTAGE Vg
PRIMARY CURRENT i
SECONDARY VOLTAGE V2
WITHOUT SHIFT OF GATE VOLTAGE
Vo
Vm
(NORMAL STATE)
(ABNORMAL STATE)

INTERNAL COMBUSTION ENGINE IGNITION DEVICE AND IGNITER FOR SAME

BACKGROUND OF THE INVENTION

1. Field of the Invention

The present invention relates to an internal combustion engine ignition device able to suppress misfires etc. of an internal combustion engine at abnormal times and an igniter for the same.

2. Description of the Related Art

In the case of a spark ignition internal combustion engine fueled by gasoline, alcohol, etc. (hereinafter simply referred to as an "engine"), a secondary coil of an ignition coil is made to generate a high voltage and that high voltage is supplied to a spark plug so as to cause spark discharge across the gap of the spark plug. Due to this spark discharge, the compressed air-fuel mixture in the combustion chamber is ignited and burned. At this time, the discharge timing of the spark plug, that is, the ignition timing, largely governs the performance of the engine, so is precisely controlled in accordance with the rotational speed of the engine.

However, for example, when an abnormality etc. occurs in the electronic control unit (ECU) controlling the ignition timing and the ignition signal continues for a long time (for example, several seconds), the precise control of the ignition timing becomes impossible. Therefore, the air-fuel mixture of the engine can detonate due to a misfire and damage the engine etc. Even if such detonation of the air-fuel mixture does not occur, if the ignition signal continues for a long period of time, the primary coil of the ignition coil or the drive device (igniter) of the primary coil will be overheated by the large current running through it for the long period. Such overheating can become a cause of damage to the equipment or thermal runaway. Therefore, measures against such abnormal conditions have been disclosed for example in Japanese Unexamined Patent Publication (Kokai) No. 8-28415 and Japanese Unexamined Patent Publication (Kokai) No. 2002-4991.

In Japanese Unexamined Patent Publication (Kokai) No. 8-28415, at the time of an abnormality where the ignition signal continues for a long time, the drive signal of the switching device (power transistor) for controlling the primary current is dropped to the ground. Due to this, the primary current is cut and heating of the switching device etc. is suppressed. If this is done, however, in the end the primary current is rapidly cut and as a result a high voltage may arise at the secondary coil and spark discharge may occur at the spark plug. Therefore, it is not possible to reliably suppress misfires of the engine.

In the case of Japanese Unexamined Patent Publication (Kokai) No. 2002-4991, to make up for the defect of Japanese Unexamined Patent Publication (Kokai) No. 8-28415, at the time of detection of an abnormality, an insulated gate bipolar transistor (IGBT), a type of power transistor, is turned off at a low speed to prevent the occurrence of a high voltage at the secondary coil. Due to this, spark discharge of the spark plug is suppressed and misfire of the engine is reliably prevented. This low speed turnoff of the IGBT is achieved by slowly reducing the reference voltage of a comparator making up part of a current limiting circuit of the primary current. In the case of Japanese Unexamined Patent Publication (Kokai) No. 2002-4991, however, slow discharge of a capacitor is utilized at the time of reducing the reference voltage. Therefore, a capacitor is an essential device. However, with increasing thinness, smaller size, and lower cost being demanded, separate provision of a bulky capacitor is not preferable. Further, it is difficult to form such a capacitor on one chip. Further, along with the drop in the primary current control value, oscillation of the primary current value is liably to occur. It is difficult to prevent this oscillation.

SUMMARY OF THE INVENTION

An object of the present invention is to provide an internal combustion engine ignition device able to suppress misfires of an engine, overheating of an igniter etc., etc. even at an abnormal time at which an ignition signal continues for a long period etc. and able to achieve greater compactness and lower cost, and an igniter for the same.

To attain the above object, the present invention provides an internal combustion engine ignition device able to suppress misfires etc. at abnormal times and achieving smaller size and lower cost, provided with a power transistor (switching device SW), a current limiting circuit (1) for limiting a primary current running through the IGBT to within a predetermined value, a fast gate voltage drop circuit (2) for making the gate voltage of the IGBT fast drop to an extent where spark discharge occurs at the spark plug (P), an abnormality detecting circuit (6) for detecting an abnormal state of an igniter (I) or electronic control unit (9) and outputting an abnormality detection signal, and a slow gate voltage drop circuit (3) having a gate voltage feed cutoff circuit (42) for cutting off the feed of the gate voltage at an abnormal time and a discharge circuit (41) for discharging the gate capacitor charge of the IGBT to make the gate voltage slowly drop to an extent where no spark discharge will occur at the spark plug.

BRIEF DESCRIPTION OF THE DRAWINGS

The object and features of the present invention will become clearer from the following description of the preferred embodiments given with reference to the attached drawings, wherein.

DESCRIPTION OF THE PREFERRED EMBODIMENTS

Figure 1:
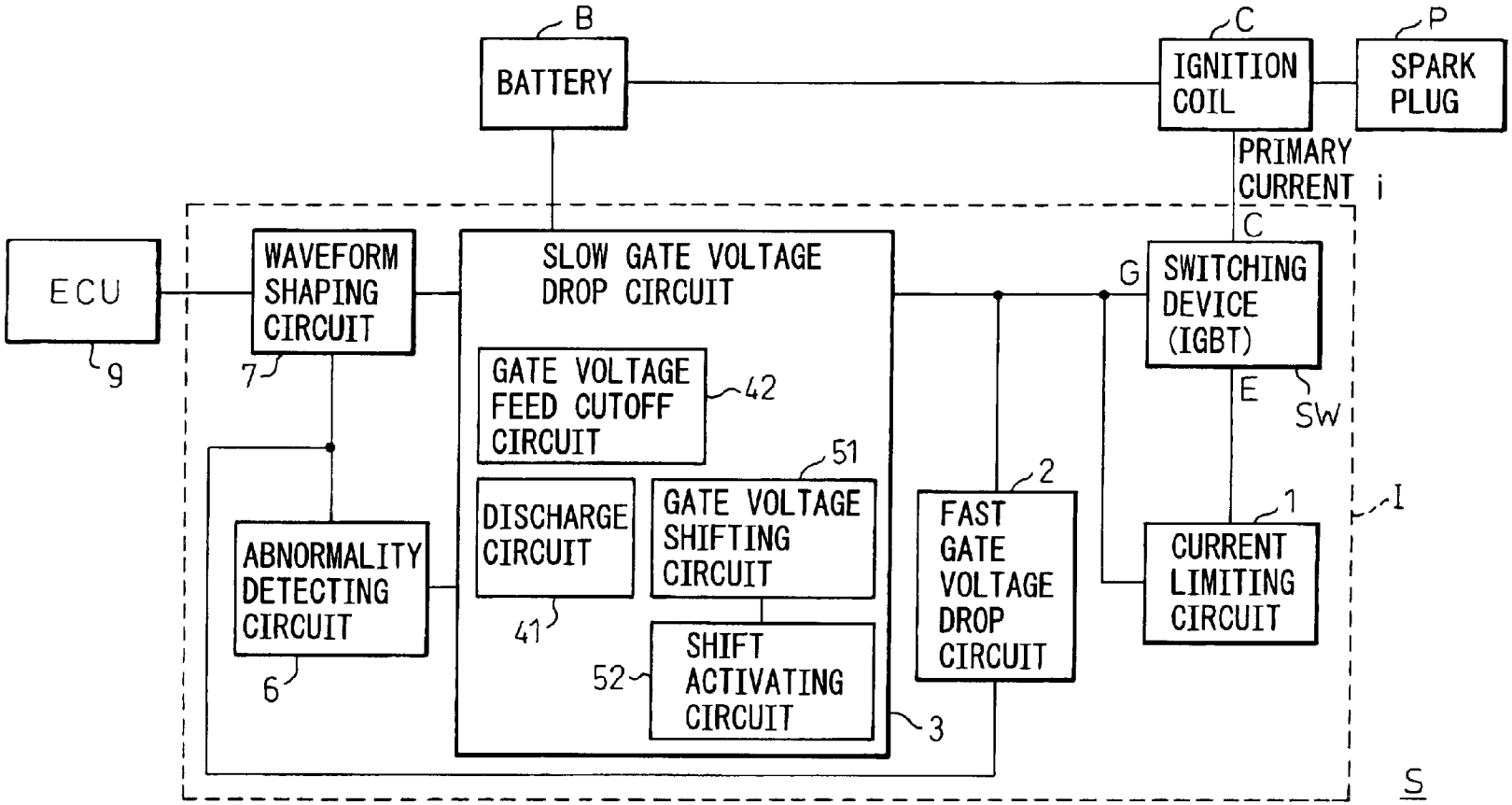
FIG. 1 is a block diagram of an entire internal combustion engine ignition device of a first embodiment of the present invention.

The inventors engaged in intensive research and trial and error to achieve this object and as a result came up with the idea of cutting off the feed of the gate voltage of the switching device controlling the primary current and discharging the gate capacitor charge so as to reduce the gate voltage and cause the primary current to slowly fall at an abnormal time at which the ignition signal continues for a long period and thereby completed the present invention.

They consequently came up with an internal combustion engine ignition device provided with a DC power source, an ignition coil having a primary coil receiving the feed of power from the DC power source and through which a primary current is run and a secondary coil able to generate a high voltage in accordance with the changing ratio per time of the primary current, a spark plug to which high voltage is supplied from the secondary coil of the ignition coil and causing spark discharge in a combustion chamber of the engine, an igniter for controlling switching of the primary current of the primary coil to cause spark discharge at the spark plug, and an electronic control unit (ECU) for outputting an ignition signal corresponding to the ignition timing of the engine to the igniter, wherein the igniter is provided with a switching device able to change the primary current in accordance with the gate voltage supplied, a current limiting circuit for limiting the primary current running through the switching device to within a predetermined value, a fast gate voltage drop circuit for making the gate voltage of the switching device fast drop to an extent where spark discharge occurs at the spark plug, an abnormality detecting circuit for detecting an abnormal state of the igniter or the electronic control unit and outputting an abnormality detection signal, and a slow gate voltage drop circuit having a discharge circuit for discharging the gate capacitor charge of the switching device to make the gate voltage slowly drop to an extent where no spark discharge will occur at the spark plug and a gate voltage feed cutoff circuit for cutting off the feed of the gate voltage at the time of detection of the abnormal state by the abnormality detecting circuit.

In the internal combustion engine ignition device (hereinafter suitably simply called the "ignition device") of the present invention, the primary current is slowly reduced at an abnormal time, so the air-fuel mixture in the engine will not detonate due to a misfire after that. Accordingly, the engine can be protected and noise can be reduced.

In the present invention, the slow gate voltage drop circuit is provided for making the primary current slowly drop. The slow gate voltage drop circuit makes the gate voltage of the switching device slowly drop so as to change the primary current. Instead of making the charge of the capacitor for creating the reference voltage slowly drop for making the current control value of the primary current slowly drop, however, the gate capacitor charge naturally built up in the switching device is made to slowly drop. Accordingly, in the case of the present invention, there is no need to provide a bulky capacitor requiring large space etc. and therefore the igniter and in turn the entire ignition device can be made smaller in size and lower in cost.

Specifically, the gate voltage feed cutoff circuit cuts off the feed of the gate voltage by a detection signal from the abnormality detecting circuit. The discharge circuit for example can be configured by a discharge resistor having a relatively large resistance value or a constant current circuit for keeping constant a relatively small discharge current. Further, the discharge circuit only passes a very small current, so has no effect at all on normal operation even in a state of continuous discharge at the time of normal operation. However, the discharge circuit may also be configured by a discharge activating circuit for activating the discharge circuit by an abnormality signal from the abnormality detecting circuit. The discharge rate, the discharge time, etc. of the slow gate voltage drop circuit can be adjusted by the resistance value of the discharge resistor. For example, the larger the resistance value, the slower the discharge is made.

However, if the discharge of the gate capacitor charge is too slow, after activation of the gate voltage feed cutoff circuit, at first a gate voltage sufficient for running a large current through the switching device is supplied, so a large primary current flows for a long time. Accordingly, the amount of heat generated by the switching device increases and the switching device will easily overheat. In particular, the amount of heat generated is proportional to the square of the current value, so if the state of a large primary current continues for a long time right after the start of activation of the slow gate voltage drop circuit, the amount of heat generated will end up becoming very large. Therefore, right after activation of the gate voltage feed cutoff circuit, it is preferable to rapidly reduce the gate voltage of the switching device to a voltage where the primary current will change in a range not causing spark discharge at the spark plug.

Due to this, the slow gate voltage drop circuit preferably has a gate voltage shifting circuit for rapidly shifting the gate voltage from an initial gate voltage before activation of the discharge circuit to a median gate voltage lower than the initial gate voltage within a range not causing spark discharge at the spark plug and a shift activating circuit for activating the gate voltage shifting circuit by input of an abnormality detection signal from the abnormality detecting circuit.

In this case, after activation of the gate voltage feed cutoff circuit, the gate voltage is made to fast drop from the initial gate voltage to the median gate voltage by activation of the gate voltage shifting circuit. Therefore, the slow gate voltage drop circuit can slowly discharge the gate capacitor charge from the lower median gate voltage. As a result, a large primary current only flows for an extremely short time and the amount of heat generated by the switching device is reduced by that extent.

Note that the speed of shift from the initial gate voltage to the median gate voltage due to the gate voltage shifting circuit may be adjusted by the impedance etc. of the circuit. Further, the median gate voltage is preferably near the gate voltage when the current control circuit is operating. In this case, the primary current starts to drop corresponding to the drop in the gate voltage accompanying activation of the discharge circuit substantially without any response delay. Therefore, the amount of heat generated at the switching device is suppressed by the amount of the better drop response of the primary current.

Further, not only is the gate voltage shifting circuit activated when an abnormal state is detected by the abnormality detecting circuit, but it can also be activated and used at normal times. For example, at normal times, it can be utilized for limiting the primary current. That is, the current limiting circuit is provided with a drop signal output circuit for outputting a gate voltage drop signal for making the gate voltage drop when the detected primary current reaches a predetermined value. The shift activating circuit is preferably one which can receive the gate voltage drop signal from the drop signal output circuit and the abnormality detection signal from the abnormality detecting circuit in parallel and which activates the gate voltage shifting circuit to make the gate voltage drop to the median gate voltage when the gate voltage drop signal is input.

In the past, a current limiting circuit operated a transistor connecting a gate voltage between the gate electrode and ground so as to limit the primary current to less than a predetermined value when the primary current reached a predetermined value. In this case, however, the change of the gated voltage is rapid, so the primary current is hard to stabilize at a predetermined value. That is, oscillation (chattering) may occur. When limiting the primary current to less than a predetermined value, the output transistor of the gate voltage shifting circuit is activated to control the gate voltage and thus limit the primary current to a predetermined value. In the past, this output transistor was operatively connected between the gate electrode and ground, but in the present invention this output transistor is operatively connected between the gate electrode and the reference voltage higher than 0V (middle voltage). Due to this, the change of the gate voltage becomes slower. The primary current also exhibits slower changes corresponding to the changes in the gate voltage. Accordingly, the oscillating state of the primary current explained above is substantially suppressed. At this time, the median gate voltage should be made a gate voltage resulting in a slightly lower current than the target value of the current control. Due to this, the primary current is held stably at the above predetermined value.

Note that by making the shift activating circuit able to receive as input in parallel the gate voltage drop signal from the drop signal output circuit and the abnormality detection signal from the abnormality detecting circuit, there is no need to separately provide a gate voltage shifting circuit, so the circuit can be simplified, the device reduced in size, and the cost lowered. Giving an example of such a gate voltage shifting circuit, it may be configured by a constant voltage circuit outputting a constant voltage (Vs) of not more than the median gate voltage and an NPN type transistor interposed between the gate of the switching device and the constant voltage circuit and intermittently switching between the gate and the constant voltage circuit. At this time, the shift activating circuit is comprised of a switching circuit comprised of another transistor etc. for turning the NPN type transistor on and off.

An NPN type transistor is utilized for intermittently switching between the gate and the constant voltage circuit because, compared with using a PNP type transistor, it is easy to simplify the circuit, stabilize operation even with a low voltage, and lower the impedance of the circuit for shifting the gate voltage to a predetermined voltage. Note that in the case of this gate voltage shifting circuit, the gate voltage (Vg) is clamped to the total voltage (Vs+Vf) of the constant voltage (Vs) of the constant voltage circuit and the drive voltage (Vf) of the NPN type transistor. That is, if the gate voltage becomes this total voltage, the NPN type transistor will automatically turn off and the gate voltage will not become lower than this total voltage (Vs+Vf). Further, when the slow gate voltage drop circuit is activated, the gate voltage will drop to the total voltage, then current will no longer flow from the constant voltage circuit to the discharge circuit. That is, the NPN type transistor functions as a diode as well.

Up until now, the explanation has been made of the case of the present invention as an internal combustion engine ignition device forming the ignition system, but the present invention is not limited to this. It is also possible to view it as an igniter suitably provided with this configuration in the above configuration or an ignition coil (stick coil) integral with this igniter.

The gate capacitor charge referred to in the specification is the charge built up at the gate part of the switching device and is determined by the voltage applied to the gate and its capacity (gate capacity). Note that the gate capacity differs from a capacitor in that it fluctuates according to the operating state of the switching device and is not always constant. The switching device may be of any type so long as it has a gate (drive terminal), that is, a gate capacity. The general practice is to use an IGBT, power MOSFET, or other power device as this switching device since normally a primary current of several or ten or so amperes flows.

The "abnormal state" detected by the abnormality detection circuit is the case where the ignition signal is continuously output due to for example an internal breakdown of the ECU, disconnection, short circuit to the power source or ground, etc. The abnormality detecting circuit in this case is for example a timer circuit. Further, an overheated state of the switching device due to an abnormality in the ignition signal, overheating of the engine, etc. is also a type of this "abnormal state". The abnormality detecting circuit in this case is for example a temperature detecting circuit for detecting the temperature of the switching device or its surroundings. At such a time, for example, even if the ignition signal is normal, the primary current will be restricted by the operation of the slow gate voltage drop circuit of the present invention and overheating of the switching device etc. will be suppressed. Further, at this time, no spark discharge occurs at the spark plug, so detonation of the air-fuel mixture in the engine etc. are prevented and the engine is protected.

The ignition device of the present invention may also be of a type which distributes high voltage generated at the secondary coil of the ignition coil to spark plugs by a distributor or may be of a type which supplies high voltage to a spark plug from an ignition coil (stick coil) provided at each cylinder. Except for a single-cylinder engine, in the former case, the numbers of ignition coils and igniters become smaller than the number of cylinders, while in the latter case, since the ignition coil and igniter are usually integrally formed, the numbers of these become the same as the number of cylinders.

In addition, the igniter of the present invention may be provided with the gate voltage drop circuit for making the gate voltage drop separately or joined with an existing circuit when the voltage of the DC power source becomes excessive in order to protect the switching device etc.

Preferred embodiments of the present invention will be described in detail below while referring to the attached figures.

First Embodiment

An overall block diagram of an internal combustion engine ignition device of a first embodiment of the present invention (hereinafter referred to as the "ignition device") is shown in FIG. 1.

The ignition device S, as shown in FIG. 1, is comprised of a spark plug P, an ignition coil C for supplying a high voltage to a plug terminal of the spark plug P, a battery B (DC power source) forming the power source, an igniter I for driving the ignition coil C, and an electronic control unit (ECU) 9 for outputting an ignition signal to the igniter I.

The ignition coil C is comprised of a primary coil C1 (FIG. 2), a secondary coil C2 arranged coaxially with this but with more turns than the primary coil C1, and a core C3 arranged at the center of the two and forming part of the magnetic circuit. The ignition coil C, more specifically speaking, is for example a stick coil provided with an igniter I at its top integrally and arranged for each cylinder of the engine.

The ECU 9 receives as input various detection signals on the engine speed, fuel injection amount, water temperature, knocking, etc., determines the optimal ignition timing in accordance with the operating state based on pre-stored maps, and outputs this ignition signal to the igniter I.

The igniter I, as shown in FIG. 1, is comprised of a switching device SW for restricting the primary current $\underline{i}$ flowing through the primary coil C1 of the ignition coil C, a current limiting circuit 1, a fast gate voltage drop circuit 2, and slow gate voltage drop circuit 3 for controlling the primary current i by the voltage supplied to a gate G (FIG. 2) of the switching device SW (gate voltage Vg), an abnormality detecting circuit 6 for detecting an abnormal state of the ignition signal or switching device SW, and a waveform shaping circuit 7 for generating a rectangular wave control signal based on the ignition signal from the ECU 9.

At normal times, the switching device SW is controlled by the current limiting circuit 1 and the fast gate voltage drop circuit 2. At abnormal times, the switching device SW is controlled by the abnormality detecting circuit 6 and the slow gate voltage drop circuit 3.

Figure 2:
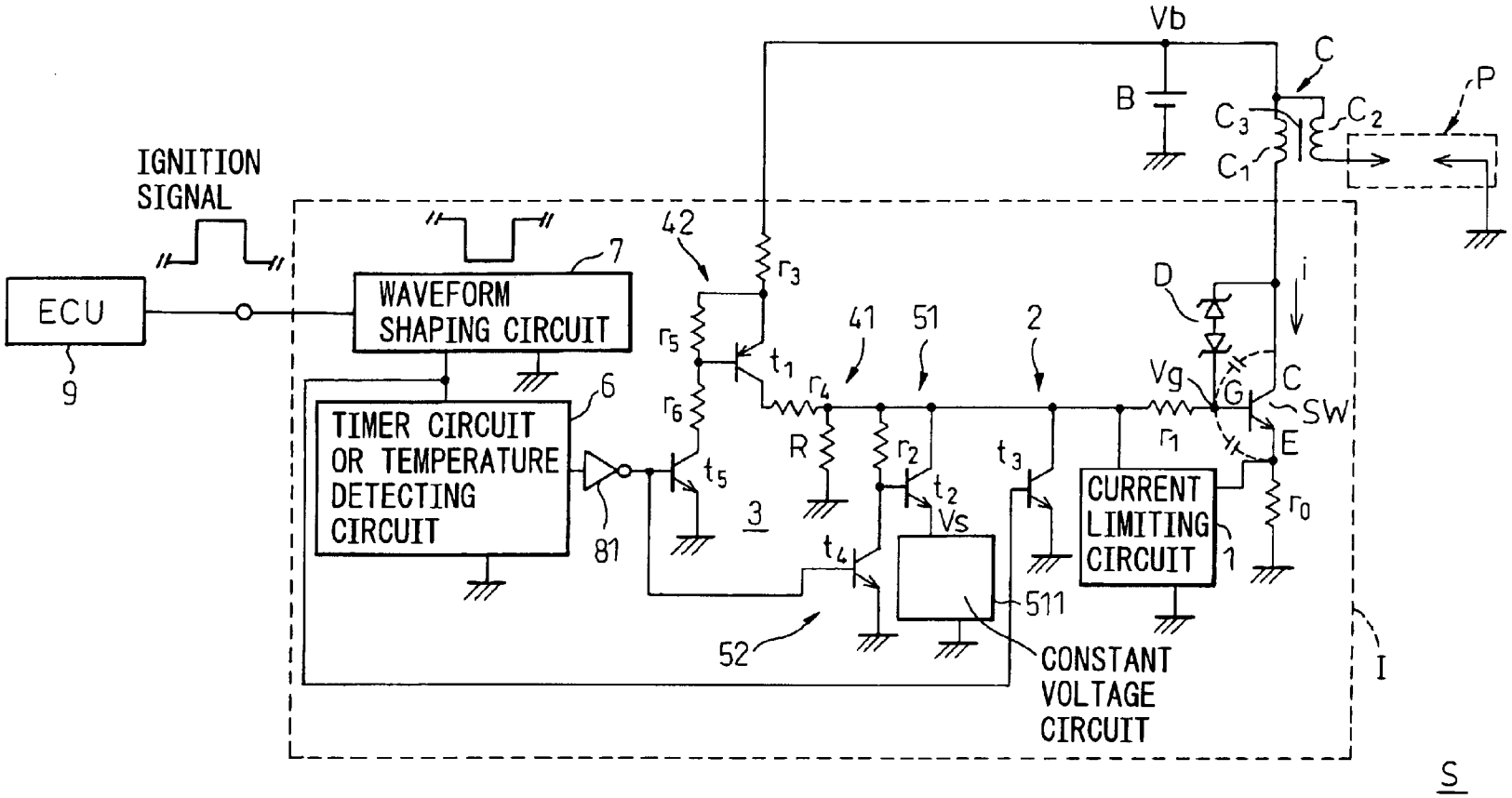
FIG. 2 is a detailed circuit diagram of the igniter part.

Next, the specific circuit configuration of these igniters I is shown in FIG. 2. First, the switching device SW is comprised of an IGBT having an emitter E and a collector C. Zener diodes D are provided between the collector C and the gate G and clamps the voltage emitted from the primary coil C1. Further, the emitter E side is connected to a shunt resistor r0 (primary current detecting circuit) for detecting the current i.

The current limiting circuit 1 detects the primary current by the terminal voltage of the shunt resistor r0. Further, it compares the detected terminal voltage and reference voltage and controls the gate voltage Vg through the resistor r1 based on the results of the comparison. Due to this, the primary current i is held to less than the above predetermined value (for example, 10A). Note that the predetermined value of the primary current i is calculated from the ignition energy etc. required for causing sufficient spark discharge at the spark plug P.

Figures 3A, 3B:
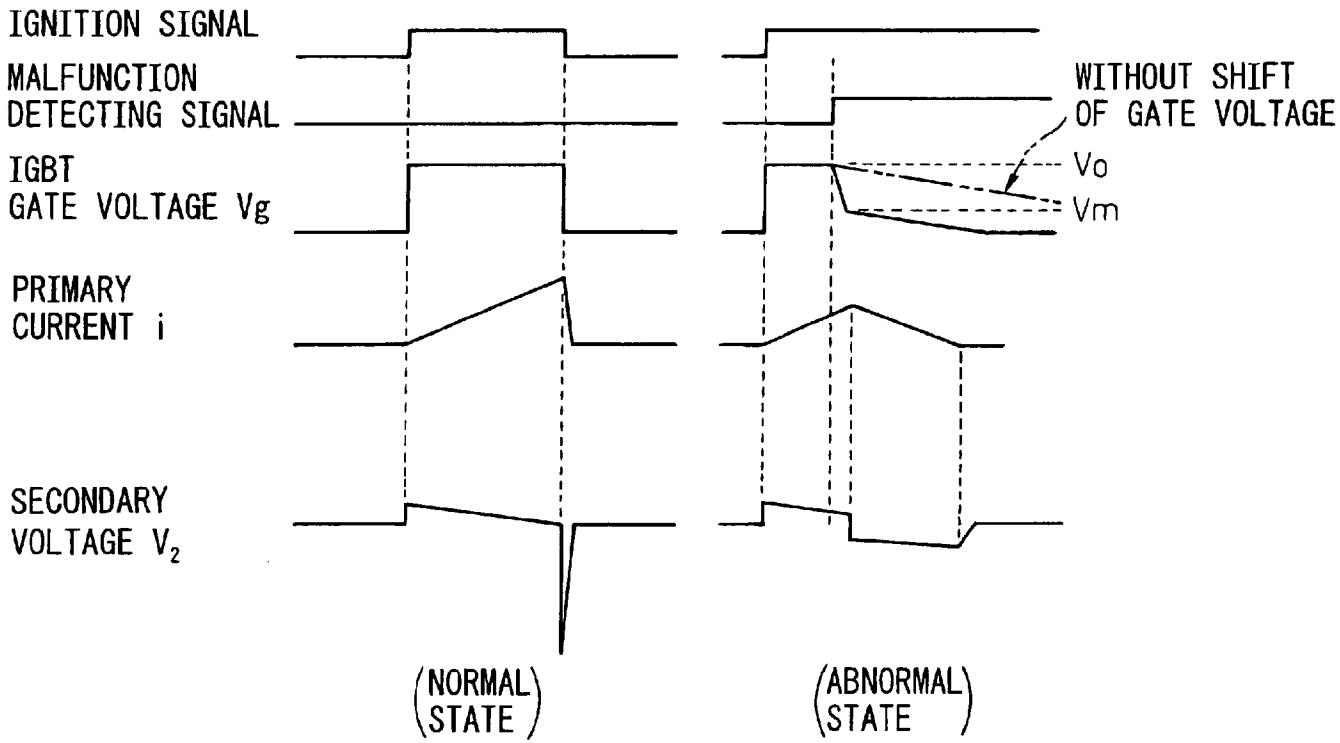
FIG. 3(*a*) is a waveform chart of a primary current, gate voltage, etc. at the time of normal operation, while FIG. 3(*b*) is a waveform chart of a primary current, gate voltage, etc. at an abnormal time.

The fast gate voltage drop circuit 2 is comprised of an NPN type transistor t3. The collector thereof is connected to the gate G side of the switching device SW, while the emitter is connected to the ground. The connection point of the collector side is common with the current control circuit 1. Further, its base receives as input a control signal which is the inverted ignition signal of the ECU 9 from the waveform shaping circuit 7. By the transistor t3 being turned on/off in accordance with the control signal, the gate voltage Vg of the switching device SW is switched between low and high. Further, when the transistor t3 is switched from off to on, the primary current i fast drops. Due to a transformer effect, an extremely high voltage (for example, −10 to 35 kV) is generated at the secondary coil C2. Due to this, spark discharge occurs at the spark plug P. The waveforms of the ignition signal, gate voltage Vg, primary current i, and secondary voltage V2 occurring at the secondary coil at normal times are shown in FIG. 3(*a*).

The slow gate voltage drop circuit 3, as shown in FIG. 1, is comprised of a discharge circuit 41, a gate voltage feed cutoff circuit 42, a gate voltage shifting circuit 51, and a shift activating circuit 52 and operates when the abnormality detecting circuit 6 detects an abnormal state.

The discharge circuit 41 is comprised by a discharge resistor R (FIG. 2) with one end connected to the gate G side of the switching device SW and the other end connected to the ground. The resistance value is set relatively large (for example, 100 k to 50 MΩ). Therefore, the gate capacitor charge built up at the gate G is slowly discharged. Note that as the discharge circuit 41 it is also possible to use, other than the discharge resistor R, a constant current circuit or to utilize the leakage current of the circuits, substrate, or switching device etc.

The gate voltage feed cutoff circuit 42 is a switching circuit for cutting off the feed of the gate voltage from the battery B and is comprised of resistors r5 (FIG. 2) and r6 and transistors t1 and t5.

When an inverted abnormality detection signal is input from the abnormality detecting circuit 6 (FIG. 2) and NOT circuit 81 to the base of the transistor t5, the transistor t5 turns off. Due to this, the transistor t1 also turns off and the gate G of the switching device SW is cut off from the battery B. Note that the resistors r1, r3, and r4 are resistors for limiting the current from the battery B of the battery voltage Vg to a suitable current value at normal times.

The gate voltage shifting circuit 51 (FIG. 2) is comprised of a constant voltage circuit 511 for outputting a constant voltage Vs and an NPN type transistor t2 which is interposed between the constant voltage circuit 511 and gate G, where the collector is connected to the gate G side and the emitter is connected to the constant voltage circuit 511 side.

The shift activating circuit 52 is a switching circuit for activating the gate voltage shifting circuit 51 and is comprised of a switching transistor constituted by the transistor t4. This transistor t4 receives as input an abnormality detection signal output from the above-mentioned abnormality detecting circuit 6 and NOT circuit 81. When the inverted abnormality detection signal is input to the base of the transistor t4, the transistor t4 turns off. Due to this, the transistor t2 turns on and the gate voltage shifting circuit 51 is activated. As a result, the gate voltage VG is clamped to less than the total voltage (Vs+Vf) of the constant voltage Vs of the constant voltage circuit 511 and the base-emitter voltage Vf of the transistor t2.

As the abnormality detecting circuit 6, for example a timer circuit or temperature detecting circuit may be considered. The timer circuit is a circuit for outputting an abnormality detection signal when the ignition signal continues for a predetermined time. The temperature detecting circuit is a circuit for detecting the temperature of the switching device SW. When giving priority to the protection of the switching device SW, it is preferable to make the abnormality detecting circuit 6 a temperature detecting circuit.

Whatever the case, when an abnormality detection signal is output from the abnormality detecting circuit 6 detecting the abnormal state, the slow gate voltage drop circuit 3 operates. First, the gate voltage feed cutoff circuit 42 cuts off the feed of the gate voltage. Right after operation, the gate capacitor charge is discharged mainly from the gate voltage shifting circuit 51. Therefore, the gate voltage Vg fast drops to near the aforementioned total voltage (Vs+Vf). Next, the gate capacitor charge is slowly discharged by the discharge resistor R, and the gate voltage Vg slowly drops. Along with the drop in the gate voltage Vg at this time, the primary current also slowly drops. In both processes of reduction of the primary current i, the voltage generated at the secondary coil C2 is small and spark discharge will not occur at the spark plug P. The waveforms of the ignition signal, gate voltage Vg, primary current i, and secondary voltage V2 occurring at the secondary coil at abnormal times are shown in FIG. 3(*b*).

Note that as shown in FIG. 3(*b*), when the gate voltage shifting circuit 51 etc. are not provided, the slow discharge by the discharge resistor R continues for a relatively long time from right after when the abnormal state is detected. Therefore, the gate voltage Vg changes slowly from the initial gate voltage V0, the large primary current i flows for a long time responding to this, and the amount of heat generated at the switching device SW increases by that amount.

As opposed to this, in the present embodiment, the slow discharge by the discharge resistor R is substantially started from the median gate voltage Vm lower than the initial gate voltage V0. Therefore, the primary current i flowing during the discharge becomes substantially smaller and the time of flow becomes shorter as well in correspondence to the shorten discharge time. The amount of heat generated due to the switching device SW is greatly reduced. Accordingly, from the viewpoint of the heat resistance as well, the switching device SW can be reduced in size and lowered in cost.

Second Embodiment

Figure 4:
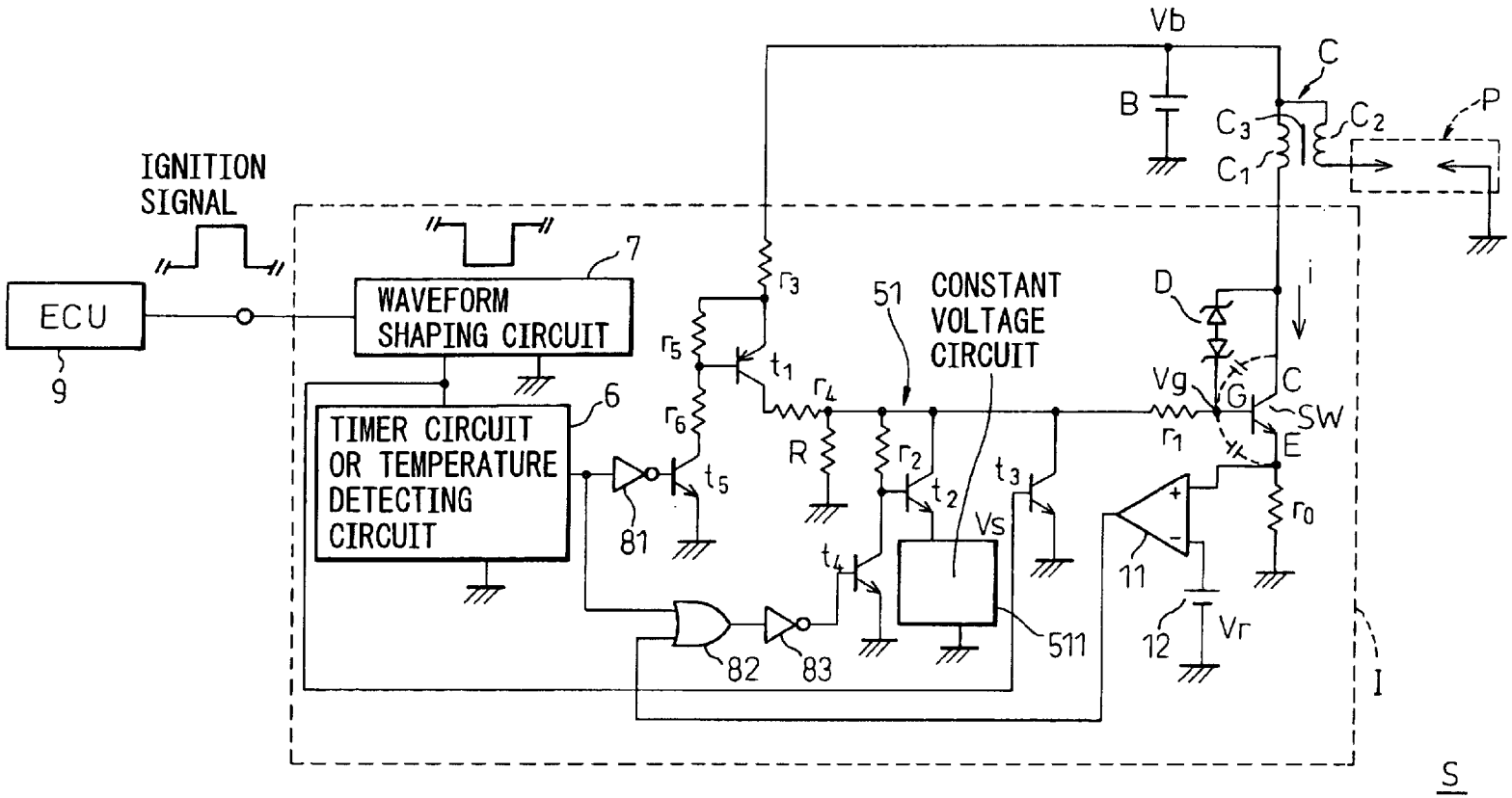
FIG. 4 is a detailed circuit diagram of an igniter part of the second embodiment.

An overall circuit diagram of an ignition device S of a second embodiment of the present invention modifying part of the first embodiment is shown in FIG. 4. Members the same as the first embodiment are assigned the same notations and detailed descriptions thereof are omitted.

In the case of the present embodiment, the current limiting circuit 1 of the first embodiment is made a drop signal output circuit comprised of a comparator 11 and a reference voltage source 12 having the reference voltage Vr. In the drop signal output circuit, the comparator 11 compares the terminal voltage of a shunt resistance r0 and reference voltage Vr and outputs a gate voltage drop signal from the comparator 11 when the terminal voltage is found, as a result of the comparison, to be larger than the reference voltage Vr (when primary current i flows more than predetermined value).

The gate voltage drop signal is input through the OR circuit 82 and the NOT circuit 83 to the base of the transistor t4. Note that the OR circuit 82 also receives as input in parallel an abnormality detection signal before inversion.

Further, if the transistor t4 receives as input the inverted signal of the above gate voltage drop signal, in the same way as the first embodiment, the transistor t4 turns off and the gate voltage shifting circuit 51 activates. Due to this, the gate voltage Vg fast drops to near the total voltage (VS+Vf) and the primary current i drops. If the terminal voltage of the shunt resistor r0 drops due to the drop in the primary voltage i, the gate voltage drop signal will no longer be output from the comparator 11. Further, the gate voltage Vg will return to the original initial gate voltage V0 and the primary current i will also increase. By repeating this in an extremely short time, the primary current i will be held to below the predetermined value.

Figure 5A:
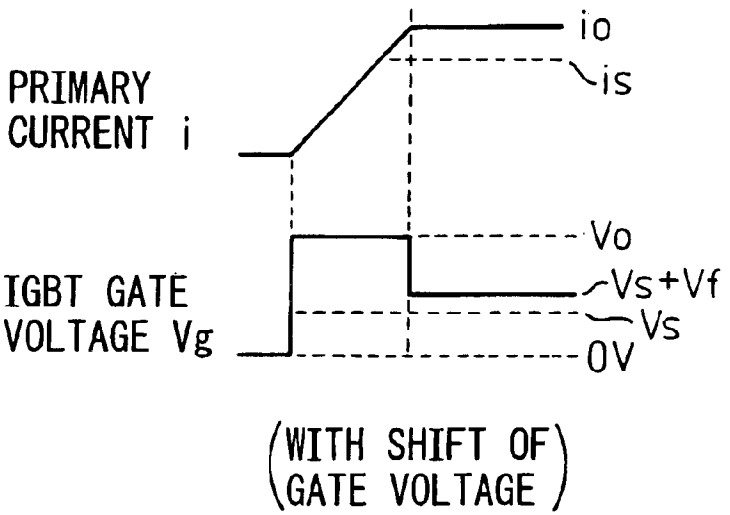
FIG. 5(*a*) is a waveform chart of a primary current and gate voltage in the case of shifting the gate voltage, while FIG. 5(*b*) is a waveform chart of a primary current and gate voltage in the case of shifting the gate voltage.
Figure 5B:
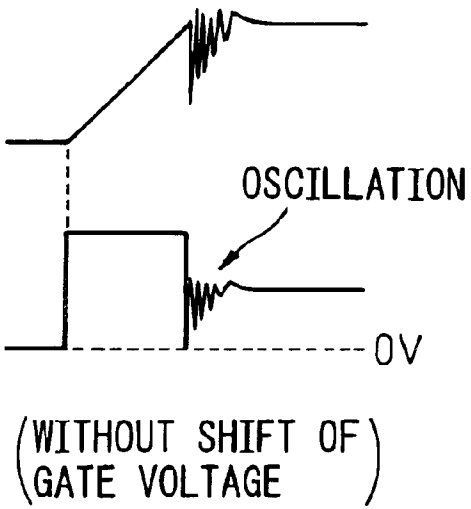

In this way, in the present embodiment, when a gate voltage drop signal is output from the comparator 11, the gate voltage Vg is not dropped directly to 0V (ground). Therefore, the change of the gate voltage Vg becomes relatively slow and chattering does not easily occur near when the primary current shifts to the saturated state. That is, the primary current i shifts to the saturated state smoothly. The state at this time is shown in FIG. 5(*a*) and FIG. 5(*b*). FIG. 5(*a*) shows the case of the present embodiment, while FIG. 5(*b*) shows the case where the gate voltage Vg is dropped to close to 0V (not going through the gate voltage shifting circuit 51). Note that in FIG. 5(*a*), the primary current i0 is the target value of the current control, while the primary current is is the saturated current value when the gate voltage is clamped to Vs+Vf. The voltage of Vs in this case has to be set to a voltage where the primary current is will not exceed the target value of the current control, that is, i0.

While the invention has been described with reference to specific embodiments chosen for purpose of illustration, it should be apparent that numerous modifications could be made thereto by those skilled in the art without departing from the basic concept and scope of the invention.

What is claimed is:

1. An internal combustion engine ignition device provided with:

a DC power source, an ignition coil having a primary coil receiving the feed of power from said DC power source and through which a primary current is run and a secondary coil able to generate a high voltage in accordance with the changing ratio per time of said primary current, a spark plug to which high voltage is supplied from said secondary coil of said ignition coil and causing spark discharge in a combustion chamber of the engine, an igniter for controlling switching of said primary current of the primary coil to cause spark discharge at said spark plug, and an electronic control unit (ECU) for outputting an ignition signal corresponding to the ignition timing of the engine to said igniter, wherein:

said igniter is provided with:

a switching device able to change said primary current in accordance with the gate voltage supplied, a current limiting circuit for limiting the primary current running through said switching device to within a predetermined value, a fast gate voltage drop circuit for making the gate voltage of the switching device fast drop to an extent where spark discharge occurs at said spark plug, an abnormality detecting circuit for detecting an abnormal state of said igniter or said electronic control unit and outputting an abnormality detection signal, and a slow gate voltage drop circuit having a discharge circuit for discharging the gate capacitor charge of said switching device to make said gate voltage slowly drop to an extent where no spark discharge will occur at said spark plug and a gate voltage feed cutoff circuit for cutting off the feed of the gate voltage at the time of detection of the abnormal state by said abnormality detecting circuit.

2. An internal combustion engine ignition device as set forth in claim 1, wherein said slow gate voltage drop circuit has a gate voltage shifting circuit for rapidly shifting said gate voltage from an initial gate voltage before activation of said discharge circuit to a median gate voltage lower than said initial gate voltage within a range not causing spark discharge at said spark plug and a shift activating circuit for activating said gate voltage shifting circuit by input of an abnormality detection signal from said abnormality detecting circuit.

3. An internal combustion engine ignition device as set forth in claim 2, wherein:

said current limiting circuit is provided with a drop signal output circuit for outputting a gate voltage drop signal for reducing said gate voltage when said detected primary current reaches a predetermined value, and said shift activating circuit is one which can receive the gate voltage drop signal from said drop signal output circuit and the abnormality detection signal from said abnormality detecting circuit in parallel and which activates said gate voltage shifting circuit to make said gate voltage drop to said median gate voltage when said gate voltage drop signal is input.

4. An internal combustion engine ignition device as set forth in claim 2, wherein:

said gate voltage shifting circuit is comprised of a constant voltage circuit outputting a constant voltage of not more than the median gate voltage and an NPN type transistor interposed between the gate of said switching device and said constant voltage circuit and intermittently switching between said gate and said constant voltage circuit, and said shift activating circuit is comprised of a switching circuit for turning said NPN type transistor on and off.

5. An internal combustion engine ignition device as set forth in claim 3, wherein:

said gate voltage shifting circuit is comprised of a constant voltage circuit outputting a constant voltage of not more than the median gate voltage and an NPN type transistor interposed between the gate of said switching device and said constant voltage circuit and intermittently switching between said gate and said constant voltage circuit, and said shift activating circuit is comprised of a switching circuit for turning said NPN type transistor on and off.

6. An igniter in an internal combustion engine ignition device provided with:

a DC power source, an ignition coil having a primary coil receiving the feed of power from said DC power source and through which a primary current is run and a secondary coil able to generate a high voltage in accordance with the changing ratio per time of said primary current, a spark plug to which high voltage is supplied from said secondary coil of said ignition coil and causing spark discharge in a combustion chamber of the engine, an igniter for controlling switching of said primary current of the primary coil to cause spark discharge at said spark plug, and an electronic control unit (ECU) for outputting an ignition signal corresponding to the ignition timing of the engine to said igniter, wherein:

said igniter is provided with:

a switching device able to change said primary current in accordance with the gate voltage supplied, a current limiting circuit for limiting the primary current running through said switching device to within a predetermined value, a fast gate voltage drop circuit for making the gate voltage of the switching device fast drop to an extent where spark discharge occurs at said spark plug, an abnormality detecting circuit for detecting an abnormal state of the ignition signal of said igniter or said electronic control unit and outputting an abnormality detection signal, and a slow gate voltage drop circuit having a gate voltage feed cutoff circuit for cutting off the feed of the gate voltage when said abnormality detecting circuit detects an abnormal state and a discharge circuit for discharging the gate capacitor charge of said switching device to make said gate voltage slowly drop to an extent where no spark discharge will occur at said spark plug.

* * * * *